United States Patent [19]

Thornton

[11] Patent Number: 5,006,679

[45] Date of Patent: Apr. 9, 1991

[54] HIGH VOLTAGE SWITCH ASSEMBLY

[75] Inventor: Edward Thornton, Bristol, United Kingdom

[73] Assignee: British Aerospace Public Limited Company, London, England

[21] Appl. No.: 523,244

[22] Filed: May 14, 1990

[30] Foreign Application Priority Data

Jun. 15, 1989 [GB] United Kingdom ..... 8913744

[51] Int. Cl.[5] ..... H01H 33/04

[52] U.S. Cl. ..... 200/144 R; 200/144 C; 200/148 R; 200/148 G; 200/149 A

[58] Field of Search ..... 200/148 R, 144 C, 148 G, 200/144 R, 149 R, 149 A

*Primary Examiner*—Robert S. Macon

*Attorney, Agent, or Firm*—Cushman, Darby & Cushman

[57] ABSTRACT

A high voltage switch assembly includes a pair of electrically conductive contacts (2, 2a, 2b, 2c, 2d, 2e) connectible in a power line from a high voltage source, and a portion of solid electrically insulating exposive material (3) forming an electrically insulating barrier extending between the contacts (2, 2a, 2b, 2c, 2d, 2e). On detonation of the explosive material at a point removed from the contacts a detonation wave is propagated from the detonation point through the explosive material (3), which as it passes between the contacts (2, 2a, 2b, 2c, 2d, 2e) establishes electrical conduction therebetween to initiate a switch closing action, the gaseous products of detonation following behind the detonation wave being electrically insulating and breaking electrical conduction between the contacts (2, 2a, 2b, 2c, 2d, 2e) to initiate a switch opening action.

10 Claims, 1 Drawing Sheet

HIGH VOLTAGE SWITCH ASSEMBLY

FIELD OF THE INVENTION

This invention relates to a high voltage switch assembly and concerns, particularly but not exclusively, such as assembly capable of a succession of high speed on/off switching actions.

BACKGROUND OF THE INVENTION

High voltage switch assemblies are known for use at voltages tyically in the range of from 300 KV to 1 MV, such as high pressure gas-filled spark gap switch assemblies. Whilst such known spark gap switch assemblies are capable of providing a single on/off switching action at a speed of 5 nanoseconds or less they are not capable of providing a series of successive on/off switching actions at a fast enough rate, such as up to one switching action per microsecond. Additionally such known switch assemblies also have the drawback of remaining conductive even after the switch current has decayed to zero, and can remain conductive for times in excess of 10 microseconds due to the gas remaining ionised.

OBJECTS OF THE INVENTION

One object of the present invention is to provide a generally improved high voltage switch assembly.

Another object of the present invention is to provide a high voltage switch assembly with a capability of providing a series of successive on/off switching actions at a fast rate.

These and other objects of the present invention will become more apparent from details disclosed in the following specification where preferred embodiments of the invention are disclosed.

SUMMARY OF THE INVENTION

According to the present invention there is provided a high voltage switch assembly, including a pair of electrically conductive contacts connectible in a power line from a high voltage source, and a portion of solid electrically insulating explosive material forming an electrically insulating barrier extending between said contacts, with the arrangement being such that on detonation of the explosive material at a point removed from the contacts a detonation wave is propagated from the detonation point through the explosive material, which as it passes between the contacts establishes electrical conduction there between to initiate a switch closing action, the gaseous products of detonation following behind the detonation wave being electrically insulating and breaking electrical conduction between the contacts to initiate a switch opening action.

Preferably the assembly includes means for detonating the explosive material.

Conveniently the portion of explosive material is elongated in form, and the assembly includes one or more further pairs of electrically conductive contacts spaced from the first pair of contacts or each pair of contacts along the explosive material in the direction of the longitudinal axis thereof with the explosive material extending between the contacts of each pair.

Advantageously one contact of the or each pair is or are provided on a first electrically conductive electrode and wherein the other contact of the or each pair is or are provided on a second electrically conductive electrode, with the contacts being connectible in said power line via said electrodes, the plurality of pairs of contacts providing repetitive switching actions.

Preferably the assembly includes electrically insulating material located between the electrodes and explosive material and between electrode portions providing said contacts.

Conveniently the or each contact and/or the or each electrode is made of brass, aluminium, copper or any easily machinable metallic material compatible with the explosive material utilised.

DESCRIPTION OF THE DRAWINGS

For a better understanding of the present invention and to show how the same may be carried into effect, reference will now be made, by way of example, to the accompanying drawing, in which.

DESCRIPTION OF EMBODIMENTS OF THE INVENTION

Figure 1:
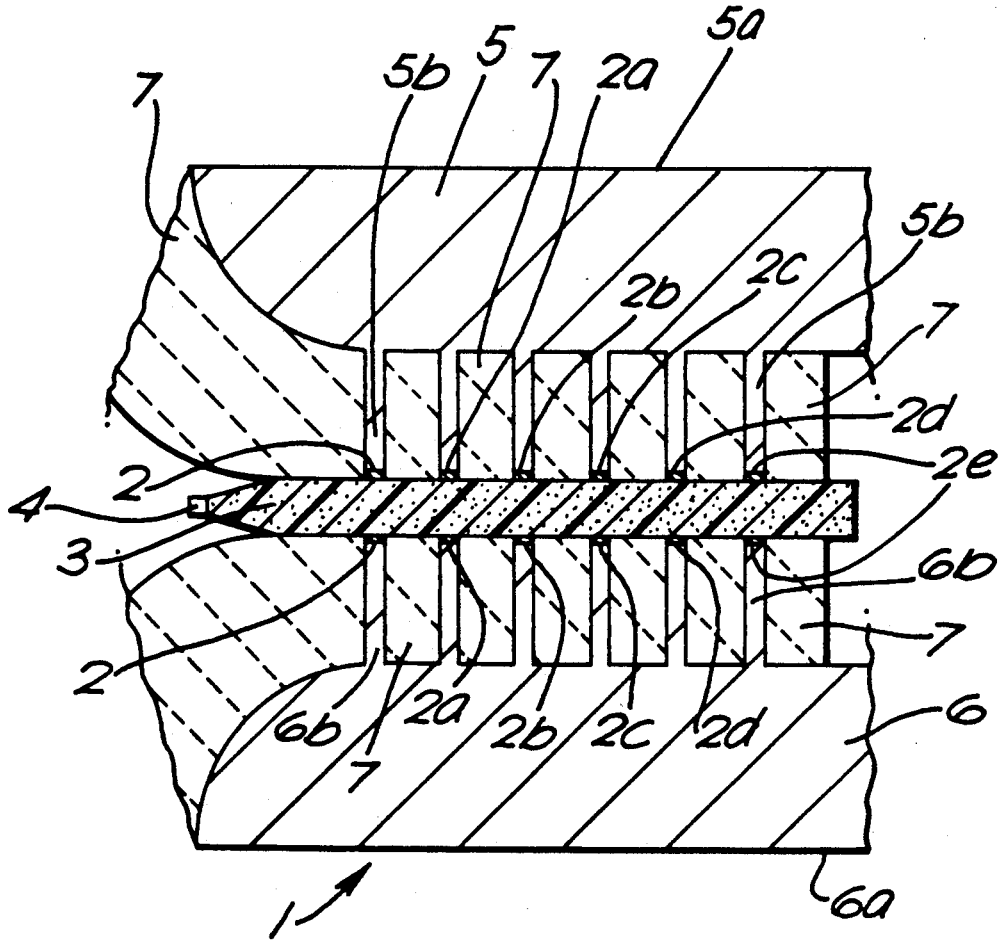
FIG. 1 is a diagrammatic longitudinal cross-sectional view through a high voltage switch assembly according to one embodiment of the invention, which is multiple acting.

A high voltage switch assembly of the present invention basically makes use of the detonation properties of a high explosive material such as PBX-9502 which is a plastic explosive commonly used for shaped charges. Such high explosive materials can be manufactured in sheet or block form and are electrically insulating in the solid form. The degree of electrical insulation properties is close to that of common electrically insulating materials such as polythene. When the explosive material is detonated a detonation wave propagates from the initiation or detonation point. Ionisation occurs at the detonation front which thereby becomes electrically conductive. This detonation wave front which becomes electrically conductive is extremely thin of the order of less than 0.1 mm in thickness. In most suitable explosive materials the detonation wave front moves with a velocity in the order of 10 mm per microsecond.

Following behind the detonation wavefront in the explosive material are hot gaseous detonation products at extremely high pressure. These explosion products are electrically insulating within 0.1 mm of the detonation wave front, that is within 0.01 microseconds.

These properties of solid electrically insulating explosive material are utilised, according to the invention, to provide a high voltage switch assembly generally illustrated at 1 in FIG. 1. Basically the assembly includes a pair of electrically conductive contacts 2 connectible in a power line from a high voltage source (not shown). The contacts 2 may be made of any suitable electrically conductive material such as brass, aluminium, copper or any easily machinable metallic material compatible with the explosive material utilised. One of the contacts 2 may be charged from a Marx generator to provide a voltage in the range of from 100 kv to 1 MV.

A portion of solid electrically insulating explosive material 3, conveniently PBX-9502, forms an electrically insulating barrier extending between the contacts 2. On detonation of the explosive material 3, conveniently by means of a detonator 4 spaced from the contacts 2 detonation starts in the explosive material at the detonator 4 and a detonation wave is propagated from the detonation point 4 through the explosive material 3 towards the contacts 2. As the detonation wave front passes between the contacts 2 it establishes electrical conduction therebetween to initiate a switch closing action. The gaseous products of detonation following behind the detonation wavefront are electrically insulating and break electrical conduction after the detonation front has passed between the contacts 2 to initiate a switch opening action. The contacts 2 may be embedded in the explosive material 3, in contact therewith or immediately adjacent thereto. As the detonation wavefront may move with a velocity of the order of 10 mm per microsecond the time duration of the switch closing action can be chosen by varying the width of the contacts 2 accordingly. The switch assembly remains closed for the time taken for the detonation wave front to pass over the contacts 2. The actual time of duration of the switch closure will be of the order of 0.1 microseconds if the contacts 2 are 1 mm in width, and the detonation wave front travels at a velocity of about 10 mm/μs.

The time of making or closing of the switch assembly is determined by the thickness of the detonation wave front which is of the order of 0.1 mm or less and its velocity. Thus the making or closing time is approximately 10 ns.

In order to provide for a series of successive on/off switching actions at a fast rate such as up to one switching action per microsecond the basic high voltage switch assembly of the invention as outlined above is further modified as shown in FIG. 1. In this modified embodiment the explosive material 3 is elongated in form, preferably cylindrical, and includes one or more further pairs of electrically conductive contacts such as the illustrated pairs 2*a*, 2*b*, 2*c*, 2*d* and 2*e*. The further pairs of contacts are spaced from the first pair of contacts 2 and from each other at any convenient distance along the explosive material 3 in the direction of its longitudinal axis with the explosive material extending between the contacts of each pair.

If the requirement for the switch assembly is to obtain ten switching actions at one microsecond intervals with an explosive material having a detonation wave propagation velocity of the order of 10 mm per second, such as with explosive PBX-9502, the pairs of contacts 2, 2*a* etc should be placed 10 mm apart. Such an explosive material is capable of sustaining, without self breakdown, an electrical stress of 40 KV per mm and a contact spacing of 10 mm will achieve a voltage stand off of the order of 400 KV. Thus in operation the detonation wavefront leaving the contacts 2, which thereby become electrically insulated 0.1 mm after passage of the detonation wave front, that is after 0.01 microseconds, will reach the next pair of contacts 2*a* 1 microsecond later and establish electrical conductivity therebetween for a further period of 0.01 microseconds.

As illustrated in FIG. 1 one contact of the or each pair of contacts 2 to 2*e* is or are provided on a first electrically conductive electrode 5 and the other contact of the or each of each pair 2 to 2*e* is or are provided on a second electrically conductive electrode 6. As aforesaid the contacts of each pair are connected in a power line from a high voltage source via the electrodes 5 and 6. To this end the electrode 5 may be connected at 5*a* to a Marx generator for charging purposes. It is assumed that the load is capacitive and that the erected Marx stores enough energy for five to ten discharges of the load. Load and Marx are assumed to be inductively coupled with a ringing frequency matching the switch assembly repetition rate. The electrode 6 is likewise connected at 6*a* to the Marx generator.

Electrically insulating material, such as a casting resin eg: epoxy resin, or a ceramic, is located between the electrodes 5 and 6 and the explosive material 3 and between electrode portions providing the contacts 2 to 2*e*.

Each electrode may be made of any suitable easily machinable metallic material compatible with the explosive material utilised, such as copper, brass or aluminium. The electrodes 5 and 6 are comb-like in longitudinal cross-section as shown in FIG. 1 with teeth-like portions 5*b* and 6*b* providing the contacts 2 at their free ends. When detonation occurs at the detonator 4 the plane wave detonation wave travels towards the pair of contacts 2. The resistance of the detonation wavefront is in the range of 0.1 to 1 ohm. The detonation wave front in the explosive material 3 passes along the edge of the insulating material 7 and a shock wave is initiated at the edge of the explosive material 3 which passes into the insulating material 7. It is desirable that this shock wave be of sufficiently low intensity and the insulating material 7 of such quality that it is not itself rendered electrically conducting at the shock surface.

To achieve such a high voltage stand off it is desirable that the switch assembly of the invention is not operated under DC conditions but is charged rapidly to the required potential in an initial time period of one microsecond or less. As the explosive material 3 is destroyed for each switching action the switch assembly is limited in use to specialist one shot operations. The amount of explosive material required and the resultant damage will normally limit the number of switch actions which are practicable per shot. However it is to be understood that the switch assembly may be re-usable by replacement of the explosive material 3 and the electrodes 5 and 6 in many instances.

A high voltage switch assembly of the invention is intended to operate at voltages in the range of from 100 KV to 1 MV at a repetition rate of 1 MHZ for a number of switching actions typically in the range of from 1 to 10. Such an assembly can be used to generate fast pulses in transient generators.

In a further embodiment of the invention, not illustrated, the electrodes 5 and 6 may be coaxial in form and contained concentrically one within the other. In this further embodiment the inner electrode would be contained completely within the explosive material 3.

Various modifications and alterations may be made to the embodiments of the present invention described and illustrated, within the scope of the present invention as defined in the following claims.

What is claimed is:

1. A high voltage switch assembly, including a pair of electrically conductive contacts connectible in a power line from a high voltage source, and a portion of solid electrically insulating explosive material forming an electrically insulating barrier extending between said contacts, with the arrangement being such that on detonation of the explosive material at a point removed from the contacts a detonation wave is propagated from the detonation point through the explosive material, which as it passes between the contacts establishes electrical conduction there between to initiate a switch closing action, the gaseous products of detonation following behind the detonation wave being electrically insulating and breaking electrical conduction between the contacts to initiate a switch opening action.

2. An assembly according to claim 1, including means for detonating the explosive material.

3. An assembly according to claim 2, wherein the portion of explosive material is elongated in form, and including one or more further pairs of electrically conductive contacts spaced from the first pair of contacts or each pair of contacts along the explosive material in the direction of the longitudinal axis thereof with the explosive material extending between the contacts of each pair.

4. An assembly according to claim 3, wherein one contact of the or each pair is or are provided on a first electrically conductive electrode and wherein the other contact of the or each pair is or are provided on a second electrically conductive electrode, with the contacts being connectible in said power line via said electrodes, the plurality of pairs of contacts providing repetitive switching actions.

5. An assembly according to claim 4, including electrically insulating material located between the electrodes and explosive material and between electrode portions providing said contacts.

6. An assembly according to claim 5, wherein the or each contact and/or the or each electrode is made of brass, aluminium, copper or any easily machinable metallic material compatible with the explosive material utilised.

7. An assembly according to claim 6, wherein the insulating material is a casting resin or a ceramic.

8. An assembly according to any one of claim 1, wherein the explosive material utilised is PBX-9502.

9. An assembly according to claim 7, wherein the portion of explosive material is cylindrical in shape, and wherein the electrodes are comb-like in longitudinal cross-section with the teeth-like portions of the electrodes providing the contacts at their free ends located in contact with or immediately adjacent to the explosive material.

10. An assembly according to claim 1, wherein one contact of the or each pair is provided on a first electrically conductive electrode, wherein the other contact of the or each pair is provided on a second electrically conductive electrode, and wherein the electrodes are coaxial in form and contained concentrically one within the other, with the innermost of said electrodes being contained within the explosive material.

* * * * *